United States Patent [19]

Abratis et al.

[11] Patent Number: 4,647,306

[45] Date of Patent: Mar. 3, 1987

[54] PROCESS FOR THE TREATMENT OF METAL MELTS WITH SCAVENGING GAS

[75] Inventors: Horst Abratis, Hagen/Teutoburger Wald; Roman Obenaüs; Klaus Schäfer, both of Georgsmarienhütte, all of Fed. Rep. of Germany

[73] Assignee: Klöckner CRA Technologie GmbH, Sulzbach-Rosenberg, Fed. Rep. of Germany

[21] Appl. No.: 756,768

[22] Filed: Jul. 18, 1985

[30] Foreign Application Priority Data

Jul. 20, 1984 [DE] Fed. Rep. of Germany ..... 3426736

[51] Int. Cl.[4] ..... C21C 7/10

[52] U.S. Cl. ..... 75/49; 75/53; 75/58; 266/218

[58] Field of Search ..... 75/53, 58, 49, 59; 266/218

[56] References Cited

U.S. PATENT DOCUMENTS 3,854,932 12/1974 Bishop ..... 75/49

3,980,469 9/1976 Forster ..... 75/49

*Primary Examiner*—Peter D. Rosenberg

*Attorney, Agent, or Firm*—Toren, McGeady & Goldberg

[57] ABSTRACT

In a process for the treatment of metal melts, such as steel melts, with scavenging gas in a ladle under reduced pressure, inert scavenging gas is supplied through a plurality of inlet devices, such as scavenging gas supply bricks, built into the ladle bottom. In order to produce a flow of scavenging gas of low energy loss and free of counter-flow in the region of gas bubbles ascending through the melt, at least two scavenging gas inlet devices are disposed in the bottom of the ladle at a spacing which is equal to from 0.3 to 0.8 times the internal radius of the bottom of the ladle.

11 Claims, 1 Drawing Figure

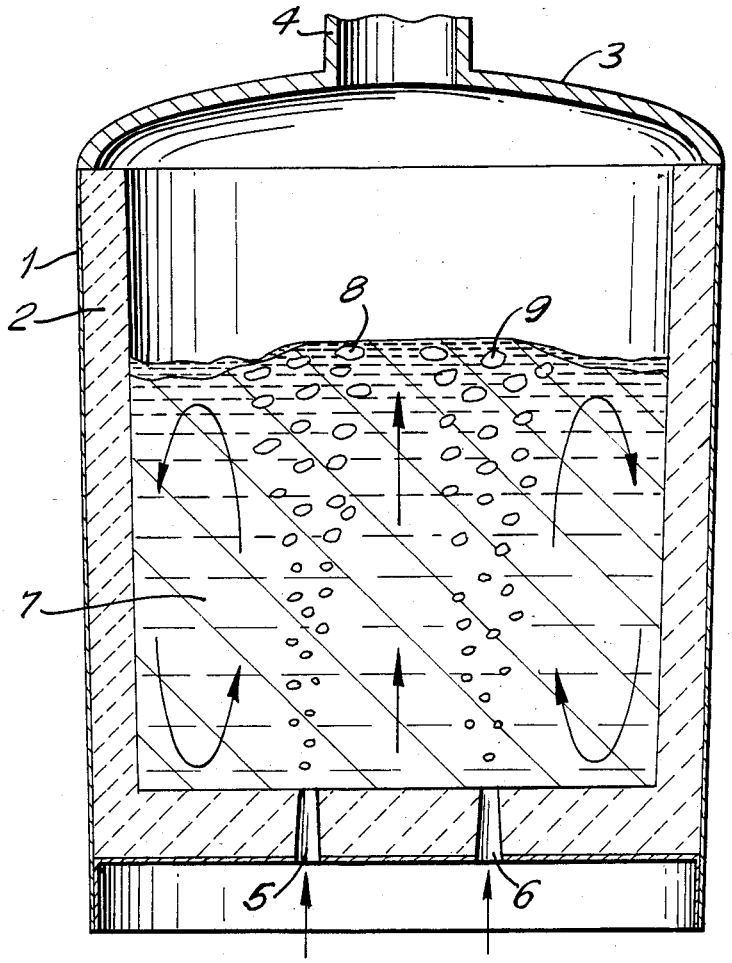
4
3
1
2
8
9
7
5
6

PROCESS FOR THE TREATMENT OF METAL MELTS WITH SCAVENGING GAS

This invention relates to a process for the treatment of metal melts, especially steel melts, with scavenging gas under reduced pressure in a transport vessel, preferably a ladle, wherein inert gas is supplied to the melt via inlet devices, such as scavenging gas supply bricks, built into the bottom of the vessel.

In the production of metals, treatment in a collecting or transporting vessel frequently follows tapping of the melt from a melting unit. The treatment vessel may be a ladle. These processes, which are sometimes called "secondary metallurgy", are used for deoxidizing, degasing, and desulphurizing the metal melts, especially steel melts, and for cleansing them of oxidic inclusions, for adding alloying agents and for homogenizing the melts in respect of chemical composition and temperature. For achieving these objectives, various degasing processes and processes for introducing scavenging gas into the melts have been disclosed. For example, scavenging gas can be blown into the metal melt via lances or scavenging gas supply bricks in the ladle wall and/or in the ladle bottom. Conical refractory bricks of high permeability, largely encased in sheet metal, have proved successful for the construction of the scavenging gas supply bricks, these bricks being held in an appropriate perforated block.

The ladle treatment of metal melts, especially steel melts, is limited in time due to the unavoidable temperature losses of the metal melt, since afterwards a sufficiently high temperature must still remain for casting the melt. For this reason, combinations of several metallurgical processes while the melt is in the ladle are disclosed in the technical literature. For example, steel degasing and the introduction of scavenging gas in the ladle bottom can be carried out simultaneously. In the disclosed processes and combinations of processes of secondary metallurgy, one scavenging gas supply brick in the ladle bottom is preferably used, although basically the use of several scavenging gas supply bricks in the ladle bottom is also known.

The object of the present invention is to combine vacuum treatment or degasing with scavenging treatment of metal melts, especially steel melts, with scavenging gas in such a manner that the total course of the combined treatments is intensified, so that, for example in the case of partly killed and fully killed steel melts having high contents of impurities, such as hydrogen and sulphur, these impurities are reduced in a specific period to much lower values, or specific contents of hydrogen and sulphur are reached in a much shorter time.

To this end, according to this invention, we provide a process for the treatment under reduced pressure of a metal melt with a scavenging gas while the melt is in a transporting vessel having a circular bottom wherein, in order to produce a gas flow which has a low energy loss and is free of counter flow in the region of ascending gas bubbles, inert scavenging gas is introduced into the melt at the bottom of the vessel through at least two scavenging gas inlet devices which are disposed in the bottom of the vessel, the inlet devices being at a spacing from each other equal to from 0.3 to 0.8 times the internal radius of the bottom of the vessel.

Surprisingly, by the provision of two or more scavenging gas inlet devices, preferably scavenging gas inlet bricks, spaced apart as described it has been found possible for the degasing of metal melts, especially steel melts, to be considerably increased and it has been found possible, for example for comparable treatment times, to achieve considerably lower hydrogen and sulphur values in the melt than were previously obtained. Underlying the invention is the surprising discovery that, on the one hand, placing the scavenging bricks or other gas inlet devices too near to one another or increasing their size and, on the other hand, spacing them too far apart in the ladle bottom, does not lead to any improvement in the treatment of the steel melt.

With the arrangement of several scavenging bricks or other gas inlet devices in the ladle bottom in accordance with this invention, when a vacuum exists above the melt the columns of bubbles of the introduced scavenging gas form close to one another, and a common, upwardly oriented flow is produced, in which regions between the columns of bubbles in which counter-flows could occur do not exist. In the limiting case, the columns of bubbles can even merge into one another in the upper part of the metal bath.

With the process of the invention, the energy introduced with the scavenging gas is largely transferred to the metal melt, and an intensive flow with good mixing within the entire melt results. The gas bubbles, consisting of scavenging gas and/or gas already evolved in the ladle, have a relatively long dwell time in the melt and thus provide a large degasing surface. Furthermore, in the case of steel treatment, the metal melt is conducted with a strong flow along the cover of slag over the melt, with the result that the conditions for transference of, for example, sulphur and oxide particles into the slag floating on the steel melt are improved.

In carrying out the process of this invention it is not necessary, in the arrangement of two or more scavenging bricks or other gas inlet devices for the centre point of the array of devices to coincide with the centre point of the ladle bottom. On the one hand three scavenging bricks can be installed at the corners of a triangle which is preferably equilateral and for which the point of intersection of the bisectors of the triangle sides coincides with the centre point of the ladle bottom, and on the other hand it is also within the concept of this invention to arrange the three scavenging bricks in any triangular form the centre of which is displaced with respect to the symmetry of the ladle bottom centre point. No problems have been created by displacing the centre point of the inlet device array by up to approximately 0.25 times the ladle bottom radius from the centre point of the ladle bottom.

It has been found advantageous, when using the process of this invention with an asymmetrical arrangement of the scavenging bricks or other inlet devices in the bottom of the treatment vessels, for unequal gas flows to be conducted through the devices in order to achieve a low-loss flow in the vessel. With this arrangement the smallest gas flow rate is conducted through the device which is nearest to the edge of the vessel. The gas flows through the individual devices can differ by up to a factor of 4. The process according to this invention permits larger gas quantities, as compared with the known processes, to be conducted through the scavenging bricks per unit time and at the same time splashing of steel and slag melt over the rim of the ladle is avoided.

Instead of gas inlet devices consisting of porous, sheet metal encased scavenging gas inlet bricks, tuyeres can be used for supplying the scavenging gas. When tuyeres are used, reactive, fine-grained solids and/or slag formers can be charged into the melt entrained in the flowing gas. The high energy transfer to the melt produced by the arrangement of the inlet devices, in this case the tuyeres, results in a longer dwell time in the melt for the solids, as for the gas bubbles, so that, for example, in the case of steel melts, the conditions for chemical reactions with dissolved sulphur and suspended oxide particles become considerably more favourable. In addition to the longer dwell time of the particles in the melt, a large reaction surface is also obtained, in relation to a largely compact slag layer floating on the steel melt.

By the arrangement in accordance with this invention of the gas inlet devices, for example scavenging gas inlet bricks, in the ladle or a similar transporting vessel, effective refining can also be carried out on metal melts such as aluminium or copper melts. With other liquid metals, similarly to what has been described in relation to steel melts, a large degasing surface becomes established in the melt by the production of an energetic, low-loss flow and the associated, longer dwell time of the gas bubbles in the melt. Thus, with other metal melts treated by the process of this invention, equally improved values can be obtained in respect of the dissolved quantities of gas and undesired impurities, as in the case of steel melts.

The drawing is a schematic illustration of a ladle for use in carrying out the process of the present invention.

In the drawing a transport vessel or ladle 1 is lined with refractory material 12, such as bricks. The ladle 1 is closed by a cover or lid 3 and an evacuation line 4 is located in the lid in communication with the interior of the ladle. Scavenging gas devices 5, 6 are located in the bottom of the ladle with the devices disposed in spaced relation. A steel melt 7 is contained within the ladle 1. The scavenging gas bubbles 8, 9 are shown flowing upwardly through the steel melt from the devices 5, 6. The devices 5, 6 can be scavenging gas inlet bricks or tuyeres.

The invention will now be explained in more detail with reference to the following example.

A steel melt having a weight of 125 t is tapped from an oxygen blowing converter into a ladle lined with basic refractory bricks. The ladle has a diameter at the bottom of 3 m and a depth of 3.7 m. During tapping to the ladle, desulphurizing agents are added to the steel melt at a rate of 5 kg/tonne of steel. A tightly closing lid is placed upon the ladle after it has been filled with steel, and scavenging gas, which in this example is argon, is fed into the melt through inlet devices built into the bottom of the ladle. The vessel consisting of the ladle and lid is then evacuated by means of steam jet pumps down to a pressure of $10^{-3}$ bar. The scavenging gas flow rate during the course of the vacuum treatment is on average 25 $Nm^3/h$ and the vacuum treatment time 20 minutes. With the known, usual arrangement of one scavenging gas supply brick at the centre of the ladle bottom, the hydrogen content is reduced in the vacuum treatment from 7.2 ppm to 2.9 ppm and the sulphur content from 0.062% to 0.032%, whereas with two scavenging gas supply bricks in the ladle bottom according to the process of this invention, with the same vacuum treatment time and the same rate of feed of desulphurizing agent, the hydrogen content is reduced from 7.4 ppm to 1.8 ppm and the sulphur content from 0.063% to 0.026%. If, on the other hand, the spacing of the scavenging gas supply bricks is made 1.2 times the radius of the ladle bottom, then a reduction in the hydrogen content from 7.5 ppm to 3.1 ppm and of the sulphur content from 0.068% to 0.035% is obtained, and these values are of the same order of magnitude as with the fitting of one scavenging gas supply brick at the centre of the ladle bottom.

We claim:

1. In a process for treatment under reduced pressure of a metal melt with a scavenging gas in which said melt is introduced into a transporting vessel having a circular bottom, the improvement comprising the step of introducing inert scavenging gas into said melt in said vessel at the bottom of said vessel through at least two scavenging gas inlet devices which are disposed in said bottom of said vessel, said inlet devices being spaced apart from each other at a spacing equal to from 0.3 to 0.8 of the internal radius.of said bottom of said vessel, whereby said gas is introduced into said melt with a flow which has a low energy loss and is free of counter flow in a region of ascending gas bubbles in said melt.

2. A process as claimed in claim 1, further comprising the step of arranging said inlet devices in an array, the centre point of which deviates from the centre point of said bottom by not more than 0.25 times said internal radius of said bottom.

3. A process as claimed in claim 1, further comprising the step of arranging said inlet devices in an array having a centre point.

4. A process as claimed in claim 3, in which there are three scavenging gas inlet devices, and further comprising the step of building said devices into said bottom of said vessel at the corners of a triangle.

5. A process as claimed in claim 4, in which said triangle is equilateral.

6. A process as claimed in claim 1, in which said gas inlet devices are supplied with gas at unequal flow rates.

7. A process as claimed in claim 1, in which said gas inlet devices are tuyeres and further comprising the step of charging at least one of fine grained solids and slag formers into said melt entrained in said scavenging gas introduced through said tuyeres.

8. A process as claimed in claim 1, in which said melt is selected from the group consisting of aluminium, and copper.

9. A process as claimed in claim 1, in which said melt is of steel.

10. A process as claimed in claim 1, in which said vessel is a ladle.

11. A process as claimed in claim 1, in which said gas inlet devices are gas supply bricks.

* * * * *